United States Patent [19]

Taksony

[11] 4,282,731

[45] Aug. 11, 1981

[54] PIN-TUMBLER-TYPE LOCK HAVING ANTIPICK SECURITY ACTION

[76] Inventor: Joseph G. Taksony, 2600 NE. Athens Way #A7, Bremerton, Wash. 98310

[21] Appl. No.: 45,238

[22] Filed: Jun. 4, 1979

[51] Int. Cl.[3] ..... E05B 63/00

[52] U.S. Cl. ..... 70/364 A; 70/419

[58] Field of Search ..... 70/369, 373, 375, 416, 70/419, 421, 358, 364 A

[56] References Cited

U.S. PATENT DOCUMENTS

| | | | |
|---|---|---|---|
| 1,953,535 | 4/1934 | Hurd | 70/422 |
| 3,349,588 | 10/1967 | Hines | 70/421 |

FOREIGN PATENT DOCUMENTS

| | | | |
|---|---|---|---|
| 104823 | 9/1966 | Denmark | 70/421 |
| 1431793 | 2/1966 | France | 70/419 |

*Primary Examiner*—Robert L. Wolfe

*Attorney, Agent, or Firm*—Christensen, O'Connor, Johnson & Kindness

[57] ABSTRACT

In a removable core-type lock, the internal tumbler pin mechanism is modified to incorporate an antipick jamming action that is actuated whenever an attempt is made to pick the tumbler pins. The jamming action comprises a pair of security tumbler pin assemblies that cooperate with the lock's cylindrical plug which incorporates the lock's keyway and serves as the primary locking element, and with a modified control sleeve structure which forms part of the jamming action and serves as a control means for releasably retaining the core in the lock's casing. In reaction to tampering of the lock by an attempt to pick the tumbler pins, one of the security pins is forced to a position that locks the control sleeve structure and plug together in a manner that prevents the opening of the lock or the removal of the core from the lock casing by means other than the use of a properly notched primary or control key.

18 Claims, 9 Drawing Figures

PIN-TUMBLER-TYPE LOCK HAVING ANTIPICK SECURITY ACTION

The invention relates to an improved, antipick security feature for pin-tumbler locks.

Although the security features of the invention are useful in a variety of different lock types and pin-tumbler configurations, the invention has particular utility in the kind of pin-tumbler lock that has a removable core. Thus, the invention is described herein by reference to removable core-type locks, but it will be recognized that the invention has broader applications.

Removable core locks are widely used in situations where there is a need to frequently change the lock keying. Such locks typically comprise an outer casing which is suitable for permanent mounting in a door, desk drawer, file cabinet, etc., and an inner core, incorporating the pin-tumbler mechanism, which is removably received within a mating opening provided in the lock casing. More particularly, the removable core includes a core housing, a cylindrical plug that has a keyway for receiving, one at a time, a primary key and a control key, and a control sleeve within which the plug is coaxially disposed. The primary key is notched to cooperate with the core's internal pin-tumbler mechanism to provide the usual locking/unlocking functions by enabling the rotation of the plug (relative to the core housing and control sleeve) so as to rotate a throw bar attached to the rear end of the plug for unlatching the door or other secured structure. The control key is notched so as to cause rotation of both the plug and an associated control sleeve relative to the core housing. The control sleeve includes a keeper lug that cooperates with the lock casing to normally retain the core in the casing until released therefrom by the aforementioned rotation of the sleeve by the control key.

The primary advantage of this type of lock is that when the primary key is lost, stolen or not returned (as in the case of a vacating tenant), the core can be quickly and inexpensively replaced with a different core, fitted with a different primary key. The removed core can be installed in another lock at a location remote from the first, or the core may be disassembled and rekeyed with a different combination of tumbler pins. The advantages of such a lock are apparent, especially when employed in a building in which a large number of offices or tenements are secured by individual locks. When an apartment or office is vacated, the building owner or landowner simply removes and exchanges the lock core, using his control key, without requiring the removal and reinstallation of the entire lock casing. Such locks are also used to advantage by businesses having a number of emloyees, each of whom is assigned a particular lock core. The assigned core may be installed in a lock casing securing a desk drawer, locker, room, compartment or the like. When a need arises to shift an employee from one desk, locker, etc. to another, then the employee simply removs his or her lock core, using the control key, and takes the core to the newly assigned station.

Unfortunately, the removable core-type lock has shortcomings. Most significantly, this type of lock is usually not as pick resistant as other kinds of pin-tumbler locks. Furthermore, such locks can be successfully picked, and the premises or other secured compartment entered, without necessarily alerting the owner of the occurrence of the unauthorized entry. Thus, the security of the lock may be breached repeatedly, without the owner becoming suspicious.

A general object of the invention is to provide improved antipick security for key-operated locks of the pin-tumbler type.

A more particular object of the invention is to improve the security of a removable core-type lock by increasing its resistance to unauthorized opening, caused by picking of the tumbler pins.

Another object is to provide such an improvement in a removable core-type lock wherein an attempted picking of the tumbler pins actuates an internal jamming mechanism that not only frustrates further picking effort but also disposes the lock in a condition that subsequently alerts the owner to the attempted, unauthorized entry.

A further and related object is to provide a removable core-type lock having the above mentioned capability of alerting the owner to a picking attempt, and also allowing the owner to quickly and easily restore a lock that has been jammed by a picking attempt, to an operative state, for temporary use until the core can be replaced with a reset jamming action.

SUMMARY OF THE INVENTION

In accordance with one principle of the invention, a pin-tumbler lock, having a housing for receiving a plug movable therein between locking and unlocking positions, and further having a keyway for receiving a key that operates tumbler assemblies movable in tumbler bores formed in the housing and plug, is modified to incorporate a phantom member that cooperates with the plug, housing and tumbler assemblies to frustrate an attempt to pick the lock. The phantom member is constructed and arranged so as to have a normal, immobile position relative to the housing. In this position, the key may be inserted into the keyway to relocate breakpoints provided on the tumbler assemblies to a primary shear line that permits movement of the plug relative to the housing and phantom member to the unlocking position. In reaction to a picking attempt, the phantom member cooperates with the tumbler assemblies such that breakpoints thereon are susceptible to being positioned at a secondary shear line at an interface between the phantom member and housing which allows the phantom member to be moved relative to the housing and jointly with the plug. In this security mode, the plug and phantom member are held together for joint movement, and stops are provided to limit the amount of movement of the phantom member, which in turn limits the plug's movement. The constrained, limited movement of the plug is insufficient to unlock the lock, thus frustrating the picking effort.

In accordance with another principle of the invention, security tumbler assemblies and associated security tumbler bores are provided for cofunctioning with the foregoing tumbler lock parts and phantom member so as to jam the plug and phantom member together, preventing subsequent independent movement of the plug, whenever a picking attempt causes displacement of the phantom member away from its normal, immobile position.

In accordance with one preferred form of the invention, these principles are embodied in a removable core lock in which the body of the core that houses the tumbler assemblies, control sleeve and cylindrical plug (defining the keyway) is modified to include, in addition to the lengthwise oriented row of conventional tumbler bores and associated tumbler assemblies, at least one security tumbler bore that is circumferentially offset from the row of conventional tumbler bores. A modified control sleeve structure, part of which provides the above-mentioned phantom member, and a modified cylindrical plug, cooperate with a security tumbler assembly mounted in the security tumbler bore such that when an attempt is made to pick the tumblers, the plug and the phantom part of the sleeve structure undergo limited rotation sufficient to cause a pin of the security tumbler assembly to drop into aligned security bores formed in the sleeve structure and plug. The security pin thereby locks the phantom part of the sleeve structure and plug together and thus jams the tumbler mechanism by preventing independent rotation of the plug relative to the sleeve structure, wherein such independent rotation of the plug is required to open the lock. The security bore that is formed in the plug does not extend into the keyway and thus, there is no way to dislodge the security pin from the jamming position by manipulating a picking tool within the plug keyway.

To increase the likelihood that an attempt at picking will cause joint rotation of the plug and sleeve structure so as to actuate the jamming mechanism, one or more of the pins in the tumbler assemblies are provided with at least one false breakpoint, which is disposed proximate the secondary shear between the sleeve structure and the core housing when the tumbler pin is in the key absent position. These false breakpoints greatly increase the odds against the lock picker positioning the true breakpoints in the pins at the primary shear between the plug and sleeve structure (which would allow independent rotation of the plug), before the antipick jamming action is actuated by rotation of the modified control sleeve structure.

The control sleeve, which is conventionally a one-piece part, is altered in accordance with one of the principles of the invention by being transversely divided into two segments including a front segment and a rear segment. The front segment functions as the above-mentioned phantom member and includes the security bore which cooperates with the security tumbler pin. The rear segment is rotatable with the plug (by use of the control key) to provide the core retaining-/releasing function of the conventional, unmodified control sleeve. The front and rear sleeve segments, when unrestrained by a tumbler pin, are free to rotate relative to the cylindrical plug and relative to each other. When using the control key for releasing the core from the lock casing, the front sleeve segment is held stationary so as to avoid the release of the security pin that would actuate the jamming mechanism. The cooperation with the primary key is similar to that of a conventional lock. For this purpose the breakpoints of the various tumbler pins are selected so that the primary key causes only rotation of the cylindrical plug, while restraining both the rear and front segments of the control sleeve structure against rotation.

In a preferred form of the invention, a pair of similar security tumbler bores and associated security tumbler pin assemblies are provided on opposite sides of and in circumferentially offset relationship to the row of conventional tumbler bores and assemblies. The pair of thusly mounted security pins are positioned for individually coacting with the common set of aligned security bores in the control sleeve segment and plug. Depending upon the direction that the plug and sleeve are forced to rotate during an attempted pick, one of the security pins will enter the aligned security bores.

Also in the preferred embodiment, each of the security pins is formed so that when either of these pins has been forced into jamming position, the thusly provided security pin breakpoint is located at the shear between the core body and the outer circumference of the control sleeve segment. In this manner, the plug and control sleeve segment, although locked together, are free to rotate as a unit within the core body. In such state, an authorized person, in possession of a properly notched key, can insert that key into the plug keyway and thereby cause the breakpoints of the conventional tumbler pins to align themselves along the operating shear line between the plug and control sleeve segments. Now, only one of the security pins obstructs rotation of the plug relative to the control sleeve segments and, by making the security pins from a material that is frangible or shearable when subjected to a shear force of a magnitude that can be applied by turning the head and shank of the key, the security pin can be sheared or otherwise fractured to allow the plug to rotate within the sleeve segments. Thus, an owner of the lock, upon discovering a picking attempt, can release the lock from its jammed condition by using the primary key in the above manner. The lock can be immediately opened for entering the premises, and can continue to be used as a lock, although the jamming action has been disarmed. Subsequently, when convenience permits, the core can be exchanged for a new one that is armed, or the core can be removed, disassembled to rearm the jamming action, and reinstalled.

These and further objects, features and advantages of the invention will become apparent from the following detailed description and accompanying drawings.

DETAILED DESCRIPTION

Figure 1:
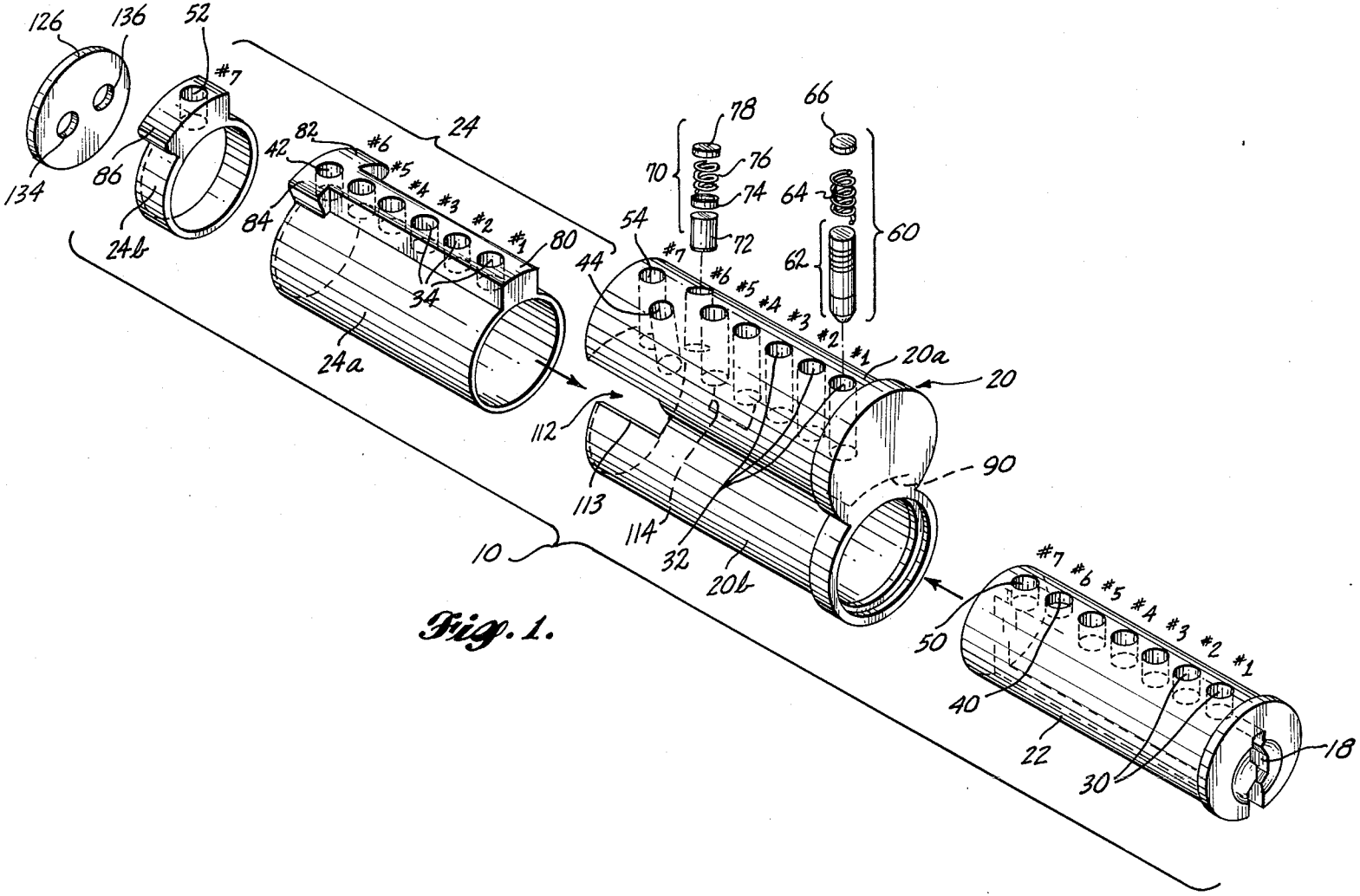
FIG. 1 is an exploded view of the removable core constructed in accordance with one embodiment of the invention.
Figure 2:
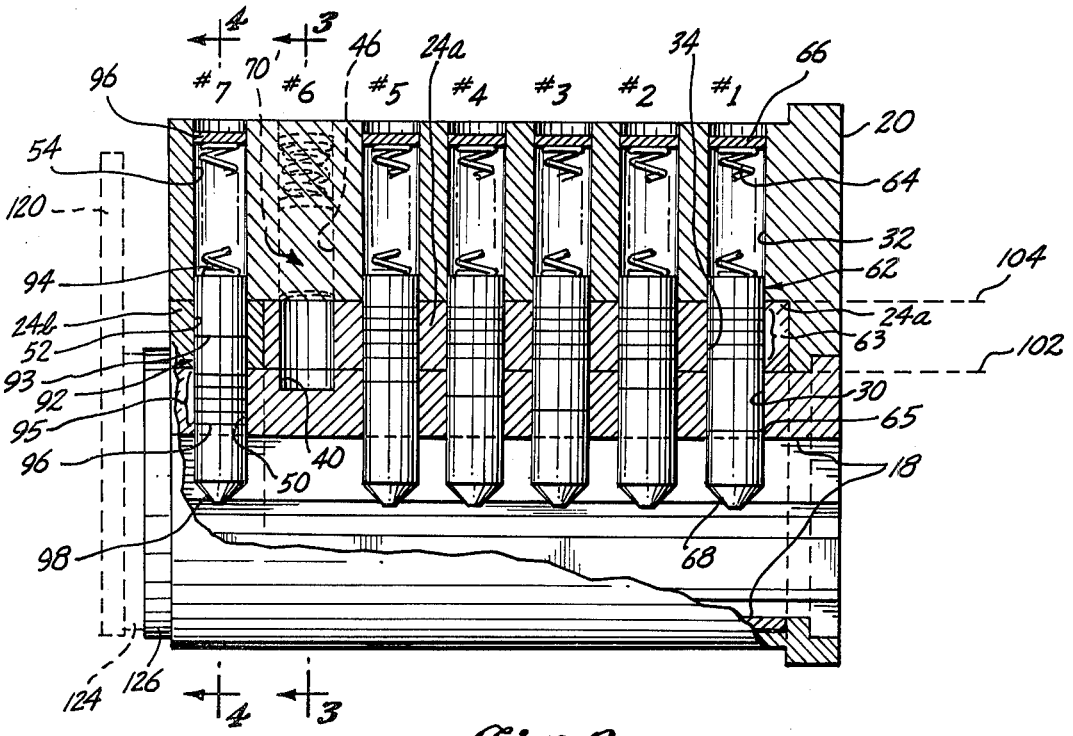
FIG. 2 is an elevation view of the assembled core, partly in vertical and lengthwise section.
Figure 8:
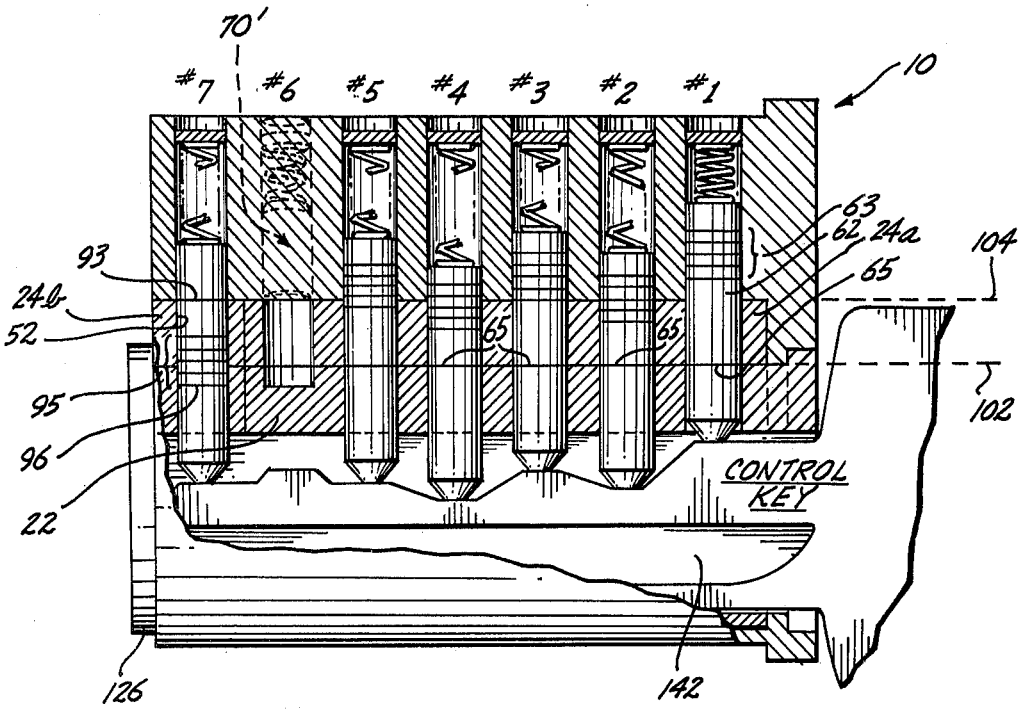
FIG. 8 is a sectional view of the core similar to FIGS. 2 and 7 but showing the core tumblers cooperating with a control key.

With reference to FIGS. 1, 2 and 8, a lock constructed in accordance with one preferred embodiment of the invention is comprised of a core assembly 10 (disassembled in FIG. 1 and assembled in FIG. 2) of the type that is removably received and retained within a lock casing 12 (FIG. 8). Although not specifically illustrated in FIG. 8, casing 12 has a cylindrically-shaped body 14 that is suitable for permanent mounting in the usual manner in one side of a door or the like, and includes a larger diameter face 16 defining an opening that extends rearwardly of casing 12 for receiving core assembly 10. As described more fully herein, core assembly 10 includes a plug keyway 18 for receiving, one at a time, either a primary key or a control key. The primary key is effective to operate the lock in the usual manner without releasing core assembly 10; and the control key is effective to release core assembly 10 for withdrawal from casing 12 through the opening in face 16.

With reference to FIG. 1, core assembly 10 comprises in general a core housing 20 having a generally solid upper lobe 20*a* and a hollow lower lobe 20*b* joined together to form a cross section generally in the shape of a figure eight; a cylindrically-shaped plug 22 that defines a lengthwise oriented keyway 18; and a transversely segmented control sleeve structure 24 comprising a front sleeve segment 24*a* and a rear sleeve segment 24*b*. The hollow lower lobe 20*b* of housing 20*a* has a generally cylindrical interior with a lengthwise recess projecting into the upper lobe 20*a* for receiving sleeve structure 24 and accommodating limited rotation of sleeve segments 24*a* and 24*b*. The interior cylindrical walls of segments 24*a* and 24*b* are in turn sized for rotatably receiving plug 22.

As shown in the assembled view of FIG. 2, housing 20, plug 22 and control sleeve structure 24 are provided with a row of tumbler positions #1 through 7, in which positions #1 through 5 are formed with conventional tumbler bores, position #6 is provided with special security tumbler bores, and position #7 is formed with a control tumbler bore.

In particular and with further reference to FIG. 1, core housing 20, plug 22 and control sleeve structure 24 include vertically alignable, conventional tumbler bores 30, 32 and 34 in plug 22, upper lobe 20*a* of core housing 20, and control sleeve segment 24*a*, respectively, for each of tumbler positions #1 through 5. When the core is assembled, as shown in FIG. 2, the individual bores 30, 32 and 34 are vertically alignable with those associated bores that occupy the same tumbler position. Thus, for example, a common tumbler bore for position #1 is formed by the vertical alignment of the forwardmost bores 30, 32 and 34 of plug 18, core housing 20 and sleeve segment 24*a*, respectively, whenever plug 18 and sleeve segment 24*a* are in the key absent position. These composite bores for positions #1 through 5 extend in the usual manner from the uppermost surface of core housing lobe 20*a* downwardly into communication with plug keyway 18.

With reference to both FIGS. 1 and 2, at tumbler position #6, a cooperating set of four security bores are provided including a vertically oriented, nonthrough bore 40 in plug 22, a vertically oriented through bore 42 in sleeve segment 24*a* and a pair of through bores 44 and 46 in core housing lobe 20*a*. Bores 44 and 46 are circumferentially and opposedly offset from the row of conventional bores 32 in lobe 20*a*.

In the rearmost tumbler position #7, a bore 50 in plug 22, a bore 52 in the rear control sleeve segment 24*b* and a bore 54 in the upper core housing lobe 20*a* form a cooperating set of through bores for accommodating the control tumbler assembly. Whenever plug 22 and rear sleeve segment 24*b* are in the key absent position, the set of bores 50–54, as viewed in FIG. 2, extend downwardly in vertical alignment from the top of core housing lobe 20*a* and open at the lower end into communication with keyway 18.

Mounted within each of the composite tumbler bores at positions #1 through 5 and #7, is a tumbler assembly 60 (FIG. 1). Each assembly 60 includes a stack 62 of tumbler pins, a biasing spring 64 and a bore closure plug 66. With reference to tumbler position #1 in FIG. 2, assembly 60 is mounted in the composite bore (30, 32 and 34) thereat so that the lowermost end 68 of stack 62 of the tumbler pins projects into keyway 18 for cooperating in the usual manner with a notched edge of a key. Plug 66 is sized to provide a forced fit within the upper end of bore 32 for securing assembly 60 in place. Stack 62, for reasons explained hereinafter, has multiple breakpoints 63 and 65, whereat each breakpoint the stack is transversely severed, to form a plurality of pin segments, lying one on top of another.

Each of the circumferentially offset security bores 44 and 46, as shown in FIG. 1, receive a security tumbler assembly 70 which includes a security pin 72, a spring cap 74 and an associated bias spring 76 topped off by a bore plug 78. Assembly 70 is received within security bore 46, as shown in FIG. 1, and another, identical security tumbler assembly 70' (FIG. 3) including security pin 72', spring cap 74', spring 76' and bore plug 78', is received within the circumferentially opposed bore 44. As described more fully herein, one or the other of security pins 72 and 72' is positioned for being forced by the associated biasing spring (76 and 76') into security bore 42 of control sleeve segment 24*a* and shallow bore 40 of plug 22, whenever control sleeve 24*a* and plug 22 are rotated slightly, one way or the other, as a result of picking the tumbler pins at positions #1 through 5 and #7. The length of pins 72 and 72' is selected to equal the composite length of bores 42 and 40 so that when either of pins 72 and 72' has been forced into bores 42 and 40, a breakpoint is presented between the upper end of the pin 72 (or 72') and the associated spring cap 74 (or 74'), the purpose of which is described hereinafter.

Figure 5:
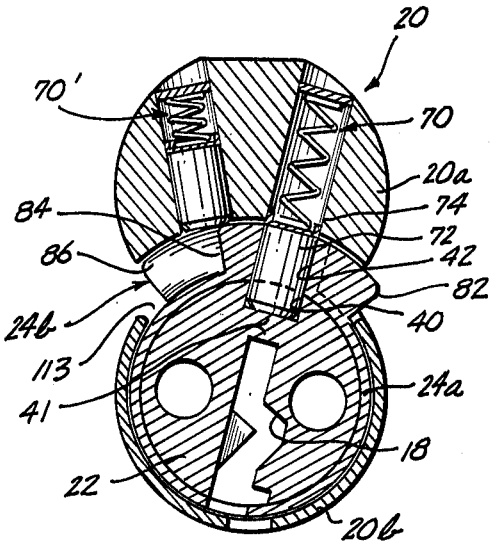
FIG. 5 is a transverse sectional view similar to FIG. 3 but showing the core in one of two lock jamming configurations.

With further reference to FIG. 1, front control sleeve segment 24*a* encompasses along its length, tumbler positions #1 through 5 and the security tumbler position #6. Along the upper extent of sleeve segment 24*a* is a rib 80 of roughly square-shaped cross section, through which bores 34 and 42 pass downwardly, opening into the interior of sleeve segment 24*a*. Adjacent the rear end of segment 24*a*, at tumbler position #6, rib 80 is formed with circumferentially, outwardly and oppositely projecting lugs 82 and 84, the upper surfaces of which are transversely rounded with a radius concentric with the center of the sleeve. Lugs 82 and 84 are nonsymmetrically shaped with respect to rib 80 such that lug 82 projects circumferentially from rib 80 by a greater amount than the projection of lug 84. As described hereinafter, lug 82 serves under certain operating conditions to retain core assembly 10 within lock casing 12, while lug 84 serves to keep the security pin assembly 70 within the upper lobe 20*a* of core housing 20 when sleeve segment 24*a* is caused to rotate clockwise, as depicted in FIG. 5.

As mentioned above, control sleeve structure 24 is divided into two segments, and the rear segment 24*b* encompasses only the rearmost tumbler position #7. The upper extent of segment 24*b* is provided with a circumferentially extending lug 86 which has a height equal to that of rib 80 and through a portion of which bore 52 passes from an upper surface downwardly into the interior of segment 24*b*. Lug 86 is nonsymmetrically oriented with respect to bore 52 such that the near side of lug 86, as viewed in FIG. 1, projects circumferentially from bore 52 by a greater degree than the far side. Also, the degree of circumferential projection of lug 86 is greater than that of lug 84 on sleeve segment 24*a*, such that when bore 52 is aligned in a row with bores 42 and 34, lug 86 projects significantly beyond lug 84.

Figure 6:
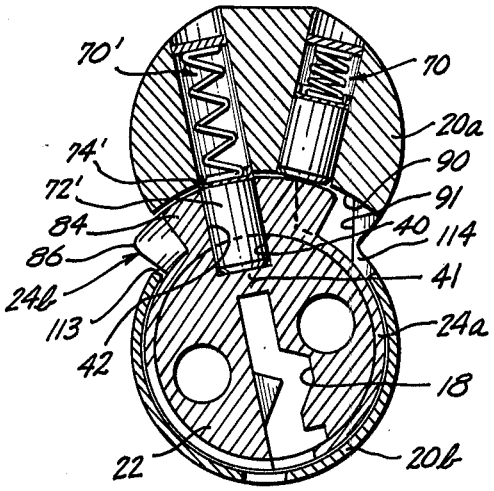
FIG. 6 is a transverse sectional view similar to FIGS. 3 and 4 but showing the core in another of the two lock jamming configurations.

The upper surface portions of rib 80, lugs 82 and 84 of segment 24*a*, and of lug 86 of segment 24*b* are rounded (arcuate in a transverse section) so as to conform to an interior cylindrical wall portion 90 formed by a recess 91 in the upper interior wall of the hollow lobe 20*b* of core housing 20 (FIG. 6). Wall portion 90 has the shape of a segment of a cylinder and recess 91 projects partly into the upper lobe 20*b* of house 20.

Figure 4:
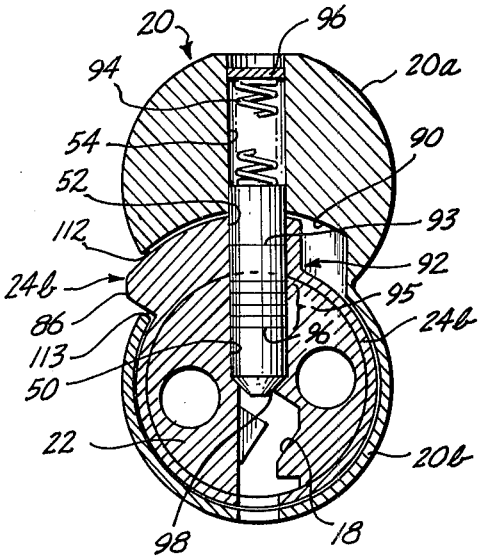
FIG. 4 is a transverse sectional view of the core taken along line 4—4 of FIG. 2.

The individual bores 50, 52 and 54 as shown in FIGS. 2 and 4 are vertically alignable for receiving a control tumbler assembly composed of a stack 92 of control tumbler pins, a biasing spring 64 and a bore plug 96. Tumbler stack 92 has multiple breakpoints 93 and 95, similar to the multiple breakpoints provided on stack 62 as described above. A lower end 98 of tumbler pin stack 92 projects downwardly into keyway 18 (see FIGS. 2 and 4) for cooperating with a notched edge of a key insertable into keyway 18.

As illustrated in FIG. 2, plug 22 and control sleeve segments 24*a* and 24*b* are arranged within core housing 20 so as to form two shear lines 102 and 104. Shear line 102 is called the primary shear line and is actually the cylindrical interface between plug 22 and sleeve segments 24*a* and 24*b* along the row of tumbler bores and associated tumbler assemblies. If there is no obstructing portion of tumbler pin at any of the tumbler positions #1 through 7 at primary shear line 102, then plug 22 will freely rotate relative to sleeve segments 24*a* and 24*b*.

Shear line 104 is called the secondary shear line and is actually the interface between the upper arcuate surface of rib 80, lugs 82 and 84 of sleeve structure segment 24*a*, and lug 86 of rear segment 24*b*, and the above described interior recessed wall 90 of core housing 20. If along secondary shear line 104, there are no obstructing segments of the tumbler pins at any of the positions #1–5 and #7, then sleeve structure 24, including segments 24*a* and 24*b*, will rotate, at least through a limited arc, relative to core housing 20. Furthermore, front control sleeve segment 24*a* can rotate independently of the rear control sleeve segment 24*b*, and vice versa, under certain conditions of operation.

In the normal mode of operation, either with the key present or absent, that portion of secondary shear line 104 which is coextensive with sleeve segment 24*a* is blocked by stacks 67 at positions #1–5 and segment 24*a* is immobilized relative to housing 20, allowing plug 22 to be selectively rotated inside of segment 24*a* when a key positions the pin breakpoints at primary shear line 102. Conversely, and as described more fully herein, segment 24*a* acts as a phantom-like security member rotating with plug 22, as though segment 24*a* were a part of the plug, when during an antipicking security mode the tumbler pin breakpoints for positions #1–5 are positioned, by picking, at secondary shear line 104. More particularly, if the tumbler pin stacks 62 at positions #1 through 5 are disposed such as to block shear line 104 and present breakpoints at shear line 102, and the stack 92 of tumbler pins at position #7 is disposed so as to present a breakpoint at shear line 104 and block shear line 102, then control sleeve segment 24*b* can be rotated by plug 22 relative to core housing 20 and also relative to the front control sleeve segment 24*a*. In such case, rotation of rear segment 24*b* is constrained to clockwise rotation from the key absent position shown in FIG. 4 since counterclockwise rotation of setment 24*b* is prevented by edge 113 of window 112. In another case, rear segment 24*b* may be held in its key absent position (FIG. 4) by stack 92 blocking shear line 104 and presenting a breakpoint at shear line 102, while front segment 24*a* is freed for being rotated by plug 22 relative to the stationary rear segment 24*b* when pin stacks 62 in positions #1–5 all present breakpoints at shear line 104 and block shear line 102.

Figure 9:
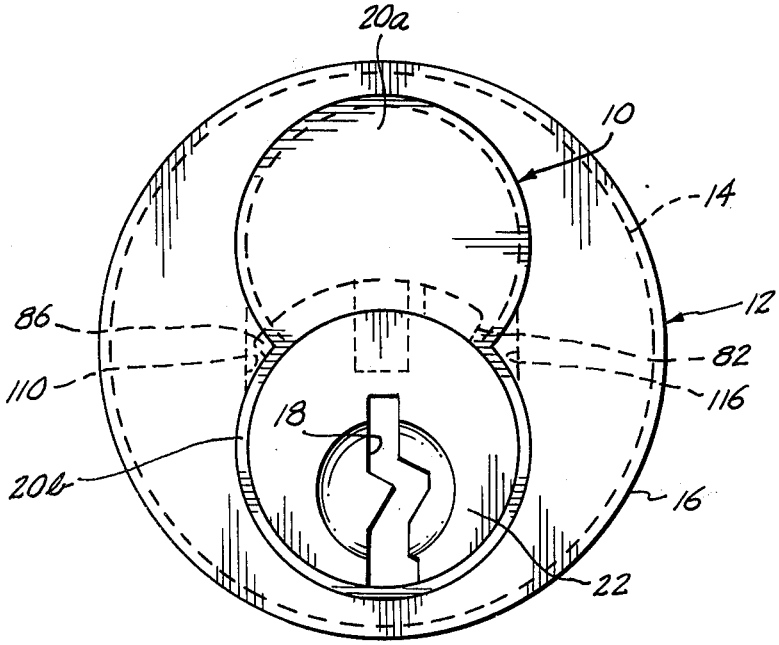
FIG. 9 is a front elevation view of the complete lock, including lock casing suitable for mounting in a door or the like, and the removable core of FIGS. 1 through 8 received within the casing.

As described more fully hereinafter, lug 86 on control sleeve segment 24*b*, and lug 82 on the front sleeve segment 24*a*, function under certain operating conditions of the lock to securely retain core assembly 10 in its assembled position within lock casing 12 (FIG. 9). Lug 86 is the principal core retaining lug and it cooperates, as illustrated in FIG. 9, with a recess 110 milled into the interior core receiving wall of the cylindrically-shaped body 14 of casing 12. For this purpose, lug 86 must project laterally beyond the side profile of core housing 20, and to accommodate this movement of lug 86, housing 20 is provided with a window 112 that intercepts both lobes 20*a* and 20*b*. Window 112 extends forwardly from the rear end of housing 20 so as to be in lateral registration with tumbler positions #7 and 6. The shape of window 112 is such as to allow lug 86 to rotate into a position, transversely projecting beyond housing 20, as illustrated in FIG. 9, so as to engage recess 110. The forward extent of window 112 serves to accommodate a slight, but needed, counterclockwise rotation of lug 84 on the forward sleeve segment 24*a*, for the operating mode depicted in FIG. 6 and described more fully hereinafter.

On the opposite side of housing 20 from window 112, another window 114 is cut out of the sidewall of housing 20, in registration with tumbler position #6, to accommodate the lateral projection of lug 82 on sleeve segment 24*a* when segment 24*a* is rotated slightly clockwise, as depicted in FIG. 5. Lug 82, in the psition as shown in FIG. 5, serves under certain operating conditions of the lock, as an auxiliary means for retaining core assembly 10 within casing 12. In particular, lug 82, when rotated to the position shown in FIG. 5, projects beyond the side profile of core housing 20 so as to engage a recess 116 (FIG. 9) milled into an interior sidewall of body 14 of casing 12, at a location generally opposite and slightly forward of milled recess 110.

Figure 3:
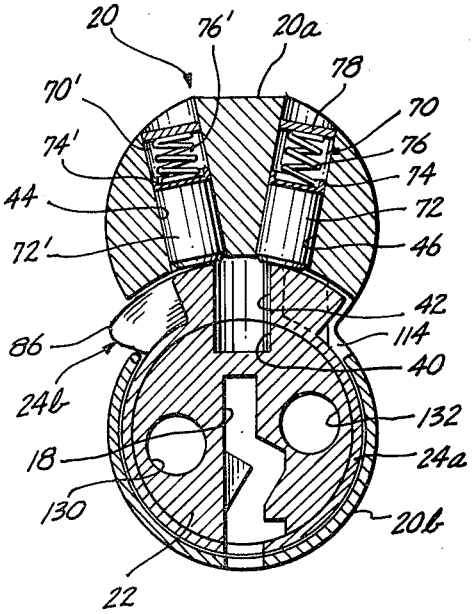
FIG. 3 is a transverse sectional view of the core taken along line 3—3 of FIG. 2.

With reference to FIG. 2, plug 22 is connected, at its rearmost end, to a throw bar 120 (shown in phantom) which is rotated by plug 22. Bar 120 is joined to plug 22 in the usual manner through a rear wall (not shown) of casing 10 by means of a spacer 124 (also shown in phantom) which mates with an opening provided in the rear wall of casing 10 and serves to retain bar 120 in place when the core assembly 10 is removed from casing 12. While not shown in the drawings, a pair of spaced, parallel prongs are affixed to throw bar 120 and spacer 124 in the usual manner for projecting inwardly of the core assembly and for being slidably received within a pair of mating, spaced, lengthwise oriented, parallel bores 130 and 132 provided in plug 22 as shown in FIG. 3. An additional spacer 126, depicted in FIGS. 1 and 2, is attached to the rear end of plug 22 and is provided with a pair of apertures 134 and 136 which are in registration with the plug bores 130 and 132. With the use of a control key, as described more fully hereinafter, core assembly 10 is removable as a unit from casing 12 by withdrawing assembly 10 forwardly through the front opening in the casing, during which plug 22 and spacer 124 are slid forwardly off of the prongs attached to bar 120 and spacer 124, such that the latter elements remain with the casing.

OPERATION

When the lock is in its normal, key absent condition, plug 22, sleeve segments 24*a* and 24*b* and the various tumbler assemblies are in the positions depicted in FIGS. 2, 3 and 4. In this position, all of the tumbler bores at tumbler positions #1–5 and #7 are vertically aligned, such as illustrated by tumbler position #7 shown in the cross-sectional view of FIG. 4. At tumbler position #6, security bores 40 and 42 of the plug and control sleeve structure are also in a vertical orientation, but in this case in a misaligned, middle position with respect to the associated, offset security bores 44 and 46 provided in the upper lobe 20*a* of core housing 20 as illustrated in FIG. 3.

Figure 7:
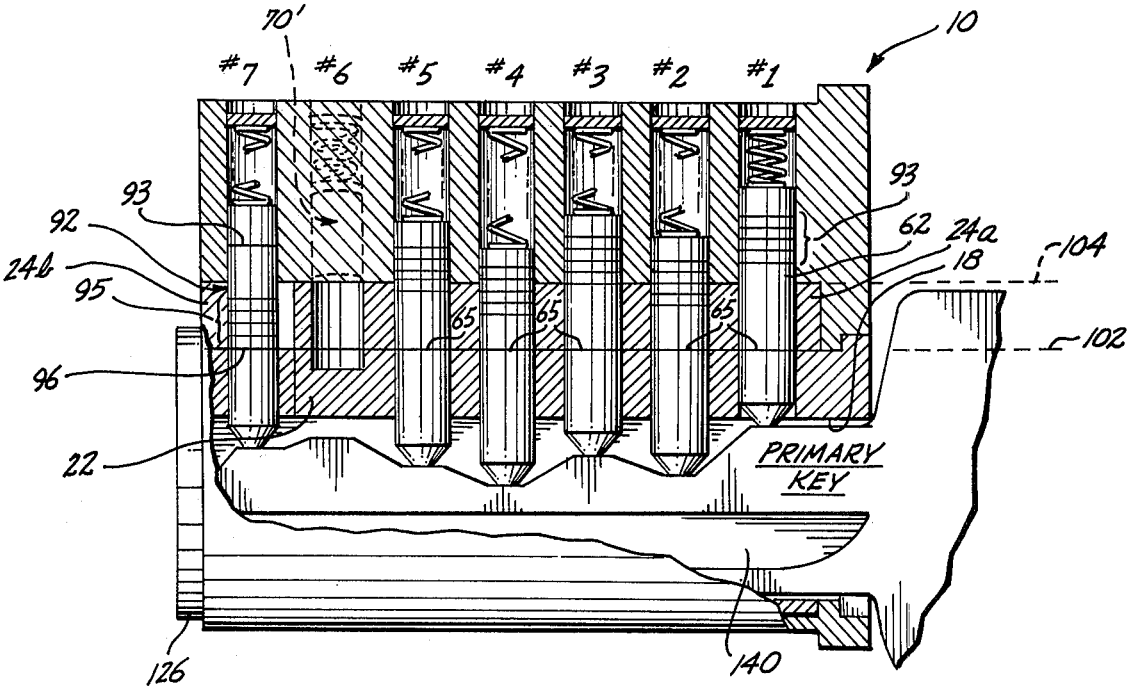
FIG. 7 is a sectional view of the core similar to FIG. 2 but showing the core tumblers cooperating with a primary key.

Core assembly 10 cooperates with the primary key 140 as illustrated in FIG. 7. In general, the actuation of the lock by primary key 140 is the same as in a conventional removable core lock. Primary key 140 is notched so as to selectively displace pin stacks 62 at tumbler positions #1–5 so as to cause the lowermost and true primary breakpoints 65 in each of these stacks to be positioned at the plug-to-sleeve or primary shear line 102. Similarly, key 140 is notched to displace tumbler pin stack 92 at the control tumbler position #7 so as to locate the lowermost and true primary breakpoint 96 at the plug-to-control sleeve shear line 102. The front sleeve segment 24*a* is held in the normal, nonrotated position by one or more tumbler stacks 62 at positions #1–5 so that neither of the offset security pin assemblies 70 or 70' is actuated. Thus, shear line 102 is not blocked at the security tumbler position #6. Tumbler stack 92 in the control tumbler position #7 is disposed so as to block the upper, secondary shear line 104 between the rear segment 24*b* and core housing 20. Accordingly, shear line 102 has been freed and key 140 is effective to rotate plug 22 within the front and rear control sleeve segments 24*a* and 24*b*, which segments remain immobilized by reason of the blocked secondary shear line 104. Rotation of plug 22 by primary key 140 rotates throw bar 120 (FIG. 2) from a locked to an unlocking position, and vice versa.

FIG. 8 illustrates the cooperation between core assembly 10 and a control key 142 for the lock. Control key 142, as in the case of a conventional removable core lock, permits the controlled removal of core assemby 10 from the lock casing 12 (FIG. 9). However, the internal operation of core assembly 10 in reaction to control key 142, is somewhat different from the operation of a conventional removable core lock. In the case of core assembly 10, only the rear control sleeve segment 24*b* is rotated by the plug 22 and control key 142 in order to release core assembly 10 from casing 12. The front control sleeve segment 24*a* remains immobilized by one or more of the tumbler stacks 62 at tumbler positions #1–5 blocking the upper, secondary shear line 104. More particularly, control key 142 is notched so as to displace tumbler stacks 62 at tumbler positions #1–5 so as to locate a pin breakpoint in the stacks for each of positions #1–5 along the primary shear line 102. In this case the same breakpoints 65 that serve as the true primary breakpoint are used for the control function. Since the secondary shear line 104 remains blocked by one or more of stacks 62 in positions #1–5, the security pin assemblies 70 and 70' (FIG. 3) remain unactuated so that neither of shear lines 102 and 104 is blocked at the security tumbler position #6. Accordingly, plug 22 is free to rotate within the stationary front segment 24*a* of the control sleeve structure, assuming that plug 22 is not restrained from such rotation at the control tumbler position #7.

At position #7, the control tumbler stack 92 is displaced by key 142 so as to locate an uppermost and true control breakpoint 93 of stack 92 at the secondary shear line 104 between the upper surface of lug 86 and the mating surface of recess 90 in core housing 20 (FIG. 4). At the primary shear line 102, stack 92 at position #7 is disposed so as to obstruct relative rotation between plug 22 and control sleeve segment 24*b*. Thus, the use of control key 142 causes plug 22 to rotate within the front sleeve segment 24*a* along shear line 102 for tumbler positions #1–6, and causes both plug 22 and the rear control sleeve segment 24*b* to rotate at shear line 104 at tumbler position #7. With reference to FIGS. 4 and 9, the rotation of control key 142 and plug 22 is constrained in this case to a slight clockwise rotation that retracts the tip of lug 86 to a position generally flush with the side profile of core housing 20 (FIG. 4) and thereby withdraws lug 86 from recess 110 in body 14 of casing 12 (FIG. 9) so that core assembly 10 is freed for removal from casing 12. To relock assembly 10 in casing 12, the foregoing procedure is simply reversed. It is noted that as in the case of a conventional removable core lock, the primary key 140 in FIG. 7 is notched so that it can only operate the lock, not remove the core assembly.

Now with reference to FIG. 2, core assembly 20 responds to various lock picking attempts in the following ways. Assume that during a typical lock picking effort, a picking tool is used in keyway 18 to apply a slight clockwise rotation (as viewed from the front of the lock) to plug 22, and simultaneously, a probe is used in keyway 18 to force each of the tumbler stacks 62 (positions #1–5) and stack 92 (position #7) upwardly, either one at a time or in a forward-rearward raking motion. The combination of the torque applied to plug 22 and the reciprocation of the pin stack breakpoints across shear lines 102 and 104 allows the picker to successively locate a breakpoint in each stack at one of the shear lines. For tumbler positions #1–5, the picker is most likely to raise pin stacks 62 so as to locate one of the multiple breakpoints 63 at secondary shear line 104. Breakpoints 63 are, however, false breakpoints, and as will be better understood from the following description, provide for leading the picker into a trap that ultimately results in the triggering of one of security pin assemblies 70 or 70'. By maximizing, within practical limits, the number of false, multiple breakpoints 63 on stacks 62, a remarkably large number of security activating, false breakpoint combinations can be provided in core assembly 10, as contrasted with only one particular combination of true breakpoints that is effective to operate the lock.

Thus, as each of the tumbler pin stacks 62 at positions #1–5 are raised by the picking probe, the odds are overwhelmingly against finding the needed combination of true breakpoints 65, and disposing such breakpoints all at the operating or primary shear line 102. Conversely, assuming that the picker is able to locate a breakpoint for each of the pin stacks 62 at positions #1-5 and locate them all on the same shear line, then in that case the most probable result will be that stacks 62 are raised so as to locate a false breakpoint 63 on each pin stack 62 at the upper, secondary shear line 104. For example, if each pin stack is raised from the key absent position as shown in FIG. 2 while applying a slight torque to plug 22, then it will be seen that the picker will probably place each pin stack with the uppermost one of multiple breakpoints 63 at the secondary shear line 104. If, on the other hand, all of the pin stacks are raised initially to their upper limit and then sequentially released while varying the torque on plug 22, then the most likely result will be to dispose a lower or intermediate one of the multiple breakpoints 63 on each stack 62 at shear line 104. Note that in order to achieve any relative rotation of plug 22 or front sleeve segment 24*a*, that the breakpoints in stacks 62, whether false or true, must be located at the same shear line, either line 102 or 104. The relative positions of the false and true breakpoints 63 and 65 with respect to shear lines 102 and 104 are selected, such as illustrated in the drawings, so as to minimize the probability of locating the breakpoints at the proper or primary shear line 102.

Assume now that the pin stacks for positions #1-5 have been picked so that given the phantom action of sleeve segment 24*a*, the multiple false breakpoints 63 are located at shear line 104 and thus front control segment 24*a* can be, if other subsequently described conditions exist, rotated relative to core housing 20. Primary shear line 102 is still obstructed by tumbler stacks 62 at positions #1-5 so there can be no relative rotation under these conditions between plug 22 and front segment 24*a*. In this connection it is noted that sleeve segment 24*a* acts as a phantom-like member, that moves as though it were an integral part of the plug, and rotates relative to the housing 20 jointly with plug 22.

Before or after picking tumbler positions #1-5 as above, the tumbler stack 92 in the control tumbler position #7 will be picked by raising stack 92 upwardly in the vertically aligned bores until a breakpoint is located either at shear line 102 or shear line 104. Preferably, when stack 92 is in its key absent position, the breakpoint 93 which serves as the true breakpoint for the control function of sleeve segment 24*b* (see FIG. 8) is located as shown in FIG. 2 at a greater distance from shear line 104 than the upper one or two breakpoints in the set of multiple false breakpoints 95. With such an arrangement, as stack 92 is raised by a picking took, the upper one of multiple breakpoints 95 will reach shear line 102 first, before breakpoing 93 is moved to shear line 104. Accordingly, the rear control segment 24*b* remains locked to core housing 20 by the upper part of stack 92 obstructing shear line 104, while plug 22 is free to rotate, at position #7, inside of sleeve 24*b*. Plug 22 may now be rotated either clockwise or counterclockwise, carrying with it the front sleeve segment 24*a*.

A slight counterclockwise rotation of plug 22 and sleeve segment 24*a* under these conditions results in the rotation of security bores 40 and 42 as shown in FIG. 6 into alignment with the bore holding the left-hand security pin assembly 70'. This triggers the release of security pin 72', which is responsively displaced by spring 76' downwardly into bores 42 and 40 of segment 24*a* and plug 22 respectively. The resulting position of security pin 72' is illustrated in FIG. 6.

In the alternative, plug 22 and front sleeve segment 24*a* may be rotated by the lock picker in a clockwise direction as viewed in FIG. 3, whereupon a slight amount of rotation from the normal, vertical position as shown in FIG. 3, causes bores 40 and 42 to become radially aligned with security pin assembly 70. In such case, pin 72 will be forced by spring 76 down into bores 42 and 40 as in the above mentioned triggering of security pin 72'. It is observed that in either case, whether plug 22 and sleeve segment 24*a* are rotated counterclockwise to result in the triggering of security assembly 70', or clockwise to result in the triggering of assembly 70, the rear control sleeve segment 24*b* may remain immobilized by the tumbler pin obstruction at shear line 104. If that is the case, lug 86 of segment 24*b* remains in the position as shown in FIG. 6, protruding from the side profile of core housing 20 and thereby ensuring the retention of the core assembly 10 in casing 12 (FIG. 9).

With reference to FIG. 5, an alternative reaction to a picking attempt can occur in which both the front sleeve segment 24*a* and the rear sleeve segment 24*b* are rotated relative to core housing 20. In this situation, tumbler stacks 62 as viewed in FIG. 2 are picked as above so as to cause some combination of false breakpoints 63 to be located along shear line 104 at tumbler positions #1-5, thereby allowing plug 22 and front sleeve segment 24*a* to rotate slightly with respect to core housing 20. Now, the picking of stack 92 at tumbler position #7 is carried out. But in this instance, stack 92 is raised so that by chance the true control breakpoint 93 is caused to be positioned at the secondary shear line 104. In such a case, a lower portion of stack 92 blocks the primary shear line 102 at tumbler position #7, such that rotation of plug 22 will carry with it the rotation of the rear control sleeve segment 24*b*.

If core assembly 10 is picked in this fashion, plug 22 can be rotated relative to core housing 20 and such rotation of the plug will carry with it, the rotation of front and rear sleeve segments 24*a* and 24*b*. Since, as viewed in FIG. 3, counterclockwise rotation of plug 22, segment 24*a* and segment 24*b* is limited by the abutment of lug 86 on rear segment 24*b*, the only permissible movement is a clockwise rotation and that results in a triggering of the right-hand security assembly 70 which forces security pin 72 down into bores 40 and 42 as illustrated in FIG. 5. It is observed that as plug 22 and control sleeve segments 24*a* and 24*b* rotate clockwise to the position shown in FIG. 5, that the core retaining lug 86 on rear segment 24*b* is caused to be retracted to a position flush with the profile of core housing 20. In this configuration, lug 86 of segment 24*b* is no longer effective to retain core assembly 10 in casing 12 as illustrated in FIG. 9. To prevent removal of core assembly 10 when disposed in the configuration shown in FIG. 5, the laterally oppositely projecting lug 82 on the front sleeve segment 24*a* is rotated to project beyond the opposite side profile of core housing 20 and thereby engage the previously described recess 116 in casing 12 and thus serve as an auxiliary means for retaining assembly 10 in place in the casing.

When one of the security pin assemblies 70 or 70' has been triggered and either pin 72 or 72' has been forced into plug and sleeve bores 40 and 42 respectively, then plug 22 and front sleeve segment 24*a* are no longer free to rotate independently. Furthermore, since rib 80 on sleeve 24*a* and opposed sides of recess 91 on core housing 20 act as stops that limit the rotation of sleeve segment 24*a* to a small arc centered about the normal, key absent position illustrated in FIG. 3, there cannot be sufficient rotation of plug 22 and throw bar 120 (FIG. 2) to the unlocking position. Thus, the lock is effectively jammed and no amount of further picking of the tumbler pins will release the core mechanism from the jammed configuration. In this respect it is noted that the nonthrough configuration of security bore 40 in plug 22 (see FIGS. 5 and 6) provides a solid barrier 41 in the plug 22 between the jamming security pin 72 or 72' and keyway 18. Thus, there is no way that a picking probe inserted through keyway 18 can be used to dislodge security pin 72 or 72' from its jamming position within bores 40 and 42.

The particular number of false, multiple breakpoints 93 and 95 for the pin stacks at tumbler positions #1–5 and 7 respectively, can, of course, vary depending upon the desired level of security. A core assembly 10 as illustrated in FIG. 2, having five false breakpoints in each of stacks 62 and 92 (in stack 92 breakpoint 96 also acts along with breakpoints 95 as a false breakpoint when the primary key is removed) provides a total of 15,625 false breakpoint combinations, as contrasted to only one true operating combination of breakpoints 65 and 96.

Furthermore, additional true breakpoints may be provided in addition to breakpoints 65, 93 and 96 for master and grand master keying. In such case, a master and/or grand master key would provide for disposing the pintumbler stacks 62 and 92 at positions different than those resulting from the use of a primary key, but nevertheless at positions corresponding to true operating breakpoints so that plug 22 can be rotated relative to the immobilized front sleeve segment 24*a*.

In a preferred form of the invention, security pins 72 and 72' are made of a relatively shearable or frangible material, and are sized so that their axial dimension fits just inside of the aligned plug and sleeve segment bores 40 and 42 as illustrated in FIGS. 5 and 6. By so dimensioning pins 72 and 72', a breakpoint in effect is provided at the upper end of each pin in conjunction with spring caps 74 and 74' respectively, so that after a security pin assembly has been actuated and the security pin (72 or 72') has been displaced to its jamming position, then the breakpoint at the upper end of the activated security pin allows the interlocked plug 22 and sleeve segment 24*a* to rotate as a unit from the clockwise or counterclockwise positions as shown in FIGS. 5 and 6 to an upright, key absent position in which the tumbler bores at positions #1–5 and #7 are all vertically aligned. By allowing plug 22 and the interlocked front segment 24*a* to rotate in this manner, a properly notched primary or control key can be inserted into keyway 18 and the jammed condition of core assembly 10 unjammed by rotating plug 22 with sufficient force so as to shear or break the security pin 72 or 72' at operating shear line 102.

More particularly, it is necessary to allow plug 22 and the interlocked sleeve segment 24*a* to rotate as a unit back to the vertically aligned key absent position in order to align the various sets of tumbler bores at tumbler positions #1–5 and #7 so that the primary key 104 or control key 142 can be entered past the lower ends 68 and 98 of the tumbler stacks. Once the properly notched key has been entered into assembly 10 such as shown in FIGS. 7 and 8, then the tumbler pin stacks 62 and 92 are displaced in the manner shown in FIGS. 7 and 8, respectively, for positioning the true breakpoints at the proper locations with respect to shear lines 102 (for primary key operation) and shear line 102 and 104 (for control key operation). Having thusly positioned the true breakpoints of the pin-tumbler stacks, only the shearable security pin 72 or 72' remains in a position obstructing the operating shear line 102. Accordingly, all of the torque applied to the key head is transformed into shear forces exerted on the security pin. In the one case, pins 72 and 72' may be made of a material such as lead that shears cleanly across the pin in reaction to the key torque; or in another case, the pin material may be of a frangible substance, such as graphite, which when forced by the key, breaks up into relatively fine particles which will allow relative rotation of plug 22 with respect to sleeve segment 24*a*. The material used for pins 72 and 72' will be selected to have a yield point, in reaction to the force rotation of the key, that is less than the yield point of pin stacks 62 and 92 so that these latter tumblers are not damaged.

It will thus be seen that a removable core assembly, constructed in the above described manner, is far more resistant to a picking attempts than would be a conventional, removable cork lock not having the antipick jamming feature provided by security pin assemblies 70 and 70'. Furthermore, the triggering of security pin assembly 70 or 70' alters the lock so that when an authorized person attempts to use a properly notched key, that person is alerted to the previous picking attempt. By providing, as preferred, security pins 72 and 72' made of a shearable or frangible material, an authorized person upon discovering that the lock has been tampered with, can use a primary key (or a control key) to immediately restore the core assembly to a condition suitable for temporary operation as a removable core lock. In such case, the the multiple false breakpoints will continue to make the lock very difficult to pick, but the jamming security feature will have been disarmed, so that it will be desirable to ultimately replace the disarmed core assembly 10 with a new one having armed security pin assemblies 70 and 70'. Although, in the alternative, the same core assembly 10 can be removed, disassembled and reconditioned with new security pins.

As an alternative embodiment, security pins 72 and 72' can be made of a nonshearable, nonfrangible high strength material such as solid brass. In this case, when one of the security pin assemblies 70 or 70' is triggered, the solid brass security pin 72 or 72' would permanently and irreversibly jam the internal mechanism of core assembly 10 so that it could not be restored for temporary operation by using an authorized key as described above.

While only particular and presently preferred embodiments have been disclosed herein, it will be readily apparent to persons skilled in the art that numerous changes and modifications can be made thereto, and equivalents substituted, without departing from the spirit of the invention. For example, while front sleeve segment 24*a* is illustrated as an integral part, it may be desirable to fabricate this component in two or more pieces and then preassemble them into an effective unit.

Moreover, although the principles of the invention have been disclosed by reference to a removable core-type lock, they may be used in other kinds of pin-tumbler locks that do not have a removable core and have variously configured plug/housing structures. Such other locks, for example, include standard cylindrical plug locks having transversely oriented tumblers, and radially arranged tumbler-type locks in which the tumbler pins reciprocate in tumbler bores oriented parallel to the axis of rotation of the plug, and in which the key is typically of tubular configuration having notches or grooves formed on the insertable end of the key. In a radially arranged tumbler lock, the phantomlike member (sleeve segment 24*a* in the disclosed embodiment) may be arranged between a forwardly positioned rotatable plug, and a rearwardly located fixed housing structure, with the tumbler assemblies arranged to reciprocate in tumbler bores that extend, parallel to the axis of plug rotation, forwardly from the fixed housing structure, through the phantom member into the plug.

The embodiments of the invention in which an exclusive property or privilege is claimed are defined as follows:

1. In a lock of the type having a casing and a core housing that houses a locking mechanism and that is releasably retained within the casing, and wherein the locking mechanism includes a cylindrical locking/unlocking plug defining a keyway and includes a core retaining control sleeve rotatably fitted on the plug and disposed therewith in the core housing, and a row of transversely oriented tumbler bores and associated primary/control tumbler assemblies so constructed and arranged in the core housing, sleeve and plug so that the tumbler assemblies have true primary and control breakpoints which respectively enable a primary key to rotate the plug relative to the control sleeve and core for unlocking the lock, and enable a control key to rotate the plug and control sleeve relative to the core housing for releasing the core housing from the casing, wherein the lock incorporates the improvement of an antipick jamming action that comprises:

said sleeve being transversely divided into first and second sleeve segments that are arranged for independent limited angular rotation relative to said core housing, said true primary/control breakpoints in said tumbler assemblies being disposed to that the primary key causes said plug to rotate relative to both said first and said second sleeve segments, and so that the control key causes said plug to rotate relative to said first segment and causes said second segment to rotate jointly with said plug relative to said core housing to release said core housing from said casing;

at least a first security tumbler bore formed in said core housing so as to intersect with said first sleeve segment, and a security tumbler bore formed in said first sleeve segment so as to extend between said core housing and plug, and a security tumbler bore formed in said plug so as to extend from said first sleeve segment inwardly into said plug, said security bores in said plug and first sleeve segment being normally aligned with each other and circumferentially offset from said first security tumbler bore in said core housing and being movable into alignment with said first security tumbler bore in said core housing when said first sleeve segment and said plug are caused to rotate relative to said core housing due to picking of breakpoints on said primary/control tumbler assemblies; and at least a first security tumbler means mounted in said first security tumbler bore of said core housing for causing said first sleeve segment and said plug to be jammed together so as to prevent relative rotation therebetween when said security tumbler bores in said plug and first sleeve segment become aligned with said first security tumbler bore in said core housing such that said plug cannot be rotated sufficiently relative to said core housing to open the lock because said plug is constrained to the limited angular rotation of said first sleeve segment.

2. The improvement as set forth in claim 1 wherein at least one of said primary/control tumbler assemblies comprises at least one false breakpoint, different from said true primary and control breakpoints, said false breakpoint being arranged so that whenever there is an attempt to open the lock by picking said tumbler assemblies, said plug and first sleeve segment are enabled by said false breakpoint to rotate relative to said core housing and thereby cause said first security tumbler means to jam to said first sleeve segment and said plug together.

3. The improvement set forth in claim 2 wherein said one of said primary/control tumbler assemblies includes a biasing spring and a tumbler pin stack defining said true primary and control breakpoints and said false breakpoint, and wherein said false breakpoint on said tumbler pin stack is disposed so that displacement of said tumbler pin stack against said biasing spring causes said false breakpoint to become positioned so as to enable joint rotation of said first sleeve segment and said plug before a true breakpoint is so positioned to enable said plug to rotate relative to said first sleeve segment.

4. The improvement set forth in claim 1 wherein said tumbler bores and associated primary/control tumbler assemblies are arranged in a lengthwise oriented row along said core housing, sleeve and plug, and said first security tumbler bore is normally disposed in the circumferentially offset relation to one side of said row, and further comprising a second security tumbler bore formed in said core housing and disposed so as to intersect with said first sleeve segment in a position that is circumferentially to an opposite side of said row from said first security tumbler bore, and further comprising a second security tumbler means mounted in said second security tumbler bore of said core housing for causing said first sleeve segment and said plug to be jammed together when said security tumbler bores in said plug and first sleeve segment become aligned with said second security tumbler bore whereby said plug's rotation is constrained to said limited angular rotation.

5. The improvement set forth in claim 1 wherein said first security tumbler means comprises a security tumbler pin that is received within said security bores of said first sleeve segment and said plug when such security bores become aligned with said first security tumbler bore in said core housing, and wherein said security pin is sized such that when it is so received in said plug and first sleeve segment security bores, said plug and first sleeve segment are jointly rotatable relative to said core housing, so that said plug and first sleeve segment can be rotated to a position that aligns said tumbler bores that contain said primary/control tumbler assemblies so that either of said keys can be received in said plug keyway, and wherein said security pin is made so as to yield in reaction to a predetermined amount of forced rotation of such key so that said plug and first sleeve segment can be freed of the jamming action in order to restore the lock to a coondition in which said primary and control keys can respectively unlock the lock, and release said core housing from the casing.

6. The improvement set forth in claim 5 wherein said primary/control tumbler assemblies are made so as to withstand said predetermined forced rotation of the key.

7. The improvement in claim 1 wherein said first security tumbler means includes a security pin that serves to jam said plug and first sleeve segment together, said security pin being made of a material and constructed so as to not yield under forced rotation of such plug.

8. The improvement set forth in claim 1 wherein said second control sleeve segment includes keeper lug means for releasably retaining said core housing within the casing, and said first sleeve segment includes an auxiliary keeper lug means for retaining said core housing within said casing when said second sleeve segment and its keeper lug means are rotated to a core releasing position jointly with the rotation of said plug and said first sleeve segment in reaction to picking of said tumbler assemblies.

9. The improvement set forth in claim 1 wherein said first security tumbler means comprises a security tumbler pin normally held in said first security tumbler bore of said core housing and a biasing spring, said biasing spring disposed and arranged in said first security bore so as to force said security pin into said security tumbler bores within said first sleeve segment and plug when they become aligned with said first security tumbler bore in said core housing.

10. The improvement set forth in claim 1 wherein said plug defines a solid wall barrier between said security bore therewithin and said keyway.

11. In a lock of the type having a casing and a core housing that houses a locking mechanism and that is releasably retained within the casing, and wherein the locking mechanism includes a cylindrical locking/unlocking plug defining a keyway and includes a core retaining control sleeve rotatably fitted on the plug and disposed therewith in the core housing, and a row of transversely oriented tumbler bores and associated primary/control tumbler assemblies so constructed and arranged in the core housing, sleeve and plug so that the tumbler assemblies have true primary and control breakpoints which respectively enable a primary key to rotate the plug relative to the control sleeve and core for unlocking the lock, and enable a control key to rotate the plug and control sleeve relative to the core housing for releasing the core housing from the casing, wherein the lock incorporates the improvement of an antipick security action that comprises:

said sleeve being transversely divided into first and second sleeve segments that are arranged for independent limited angular rotation relative to said core housing, said true primary/control breakpoints in said tumbler assemblies being disposed so that the primary key causes said plug to rotate relative to both said first and said second sleeve segments which are held stationary by said tumbler assemblies at a shear line between said sleeve segments and said core housing, and so that the control key causes said plug to rotate relative to said first segment and causes said second segment to rotate jointly with said plug relative to said core housing to release said core housing from said casing;

false breakpoint means in at least one of said tumbler assemblies that cooperates with said first sleeve segment for providing one or more false breakpoints along with said true primary breakpoints for causing said plug and said first sleeve segment to rotate conjointly when either said false or true breakpoints are positioned at the shear line between said sleeve segment and core housing during an attempt to pick the lock, such that said plug cannot be rotated sufficiently relative to said core housing to open the lock because said plug is constrained to the limited angular rotation of said first sleeve segment.

12. In a lock of the type having a housing containing a locking mechanism that includes a cylindrical locking/unlocking plug defining a keyway, and a plurality of transversely oriented tumbler bores and associated key actuated tumbler assemblies so constructed and arranged in the housing and plug so that the tumbler assemblies have true breakpoints which enable a matching key to rotate the plug relative to the housing for unlocking the lock, wherein the lock incorporates the improvement of an antipick security action that comprises:

a sleeve rotatably fitted on said plug and arranged for independent limited angular rotation relative to said housing, said true breakpoints in said tumbler assemblies being disposed so that the matching key causes said plug to rotate relative to said sleeve and housing;

false breakpoint means in at least one of said tumbler assemblies for providing one or more false breakpoints along with said true breakpoints;

at least a first security tumbler bore formed in said core housing so as to intersect with said sleeve, and a security tumbler bore formed in said sleeve so as to extend between said housing and plug, and a security tumbler bore formed in said plug so as to extend from said sleeve inwardly into said plug, said security bores in said plug and sleeve being normally aligned with each other and circumferentially offset from said first security tumbler bore in said housing and being movable into alignment with said first security tumbler bore in said housing when said sleeve and said plug are conjointly rotated relative to said housing due to picking of breakpoints on said tumbler assemblies; and at least a first security tumbler means mounted in said first security tumbler bore of said housing for causing said sleeve and said plug to be jammed together so as to prevent relative rotation therebetween when said security tumbler bores in said plug and sleeve become aligned with said first security tumbler bore in said housing, said first security tumbler means being constructed and sized relative to said first security tumbler bores in said core housing, sleeve and plug so that when said sleeve and plug become jammed together they are conjointly rotatable relative to said housing but only to the extent of said limited angular rotation of said sleeve which is not sufficient to open the lock.

13. In a pin-tumbler lock having a housing, plug means mounted for movement in said housing between locking and unlocking positions, keyway means for receiving an operating key, alignable tumbler bores provided in said plug means and housing, and tumbler assemblies arranged in said tumbler bores, the improvement comprising in combination therewith:

a phantom member arranged adjacent said plug means in said housing, said phantom member being mounted for limited movement in an antipick security mode jointly with said plug means between a first position corresponding to the locking position of said plug means and a second position corresponding to a limited intermediate position of said plug means at which said plug means remains in a locking condition, and said plug means being movable in a key-operated mode relative to said phantom member and said housing between locking and unlocking positions, tumbler bores provided in said phantom member through which said tumbler assemblies are arranged to cooperate with said alignable tumbler bores in said plug means and said housing so that a true operating shear is formed at an interface between said phantom member and said plug means, and a false shear is formed between said phantom member and said housing; and said tumbler assemblies having true breakpoints that are located so as to be positioned by said key at said true operating shear to thereby permit movement of said plug means from said locking position to said unlocking position, and said tumbler assemblies each having at least one false breakpoint located so as to be susceptible during a picking attempt to being displaced to said false shear to thereby cause said plug means and said phantom member means to be jointly movable relative to said housing so that the limited movement of said phantom member constrains the movement of said plug means and thus prevents said plug means from reaching its unlocking position.

14. The improvement in claim 13 wherein at least one of said tumbler assemblies comprises a plurality of said false breakpoints.

15. The improvement in claim 13 wherein said plug means has a generally cylindrical shape and said housing has a similarly shaped but oversized opening for receiving said plug means, and wherein said phantom member comprises a sleeve that is interfitted between said plug means and said opening in said housing.

16. The improvement in claim 13 further comprising security tumbler bore means and security tumbler means provided in said housing, phantom member and plug means for causing said phantom member and plug means to be jammed together so as to prevent relative movement therebetween when said phantom member and plug means are jointly moved to said second position in said antipick security mode.

17. The improvement set forth in claim 12 wherein said first security tumbler means is constructed so as to yield in reaction to a predetermined amount of forced rotation of the matching key, so that said plug and sleeve can be rotated to align said key actuated tumbler assemblies and associated tumbler bores to thereby permit insertion of the key, and such that said forced rotation of the key can be used to restore the lock to a temporarily usable condition in which said security action is disabled but said true breakpoints in said key actuated tumbler assemblies cooperate with said matching key to lock and unlock rotation of said plug relative to said sleeve and housing.

18. The improvement set forth in claim 12 wherein said plug defines a solid wall barrier between said security bore therewithin and said keyway, and wherein said security bores in said plug, sleeve and housing are offset along the axis of rotation of said plug from said key actuated tumbler assemblies and associated tumbler bores, whereby said first security tumbler means is inaccessible to picking through said keyway.

* * * * *